US005403442A

United States Patent [19]

Henricson et al.

[11] Patent Number: 5,403,442

[45] Date of Patent: Apr. 4, 1995

[54] METHOD OF DEAERATING AND PUMPING A FIBER SUSPENSION PRIOR TO WASHING

[75] Inventors: Kaj Henricson; Raimo Pitkänen, both of Kotka, Finland

[73] Assignee: A. Ahlstrom A Corporation of Finland, Osakeyhtio, Finland

[21] Appl. No.: 159,047

[22] Filed: Nov. 29, 1993

Related U.S. Application Data

[63] Continuation of Ser. No. 517,524, Apr. 27, 1990, abandoned, which is a continuation of Ser. No. 160,668, Feb. 26, 1988, abandoned.

[51] Int. Cl.[6] ..... D21C 9/02; B01D 51/08

[52] U.S. Cl. ..... 162/52; 162/60

[58] Field of Search ..... 162/52, 57, 60, 83; 55/15, 52, 90, 159, 194, 204, 277

[56] References Cited

U.S. PATENT DOCUMENTS

| | | | |
|---|---|---|---|
| 2,431,009 | 11/1947 | Young | 55/199 |
| 3,303,088 | 2/1967 | Gessner | 162/60 |
| 4,435,193 | 3/1984 | Gullkhsen et al. | 162/55 |
| 4,595,456 | 6/1986 | Andersson | 162/60 |
| 4,684,442 | 8/1987 | Meredith et al. | 55/204 |
| 4,686,005 | 8/1987 | Biondetti | 162/60 |

FOREIGN PATENT DOCUMENTS

| | | | |
|---|---|---|---|
| 0155928 | 9/1985 | European Pat. Off. | 162/83 |

OTHER PUBLICATIONS

Kurtz, "Deaeration: Some Practical Applications and Benefits for Pulp & Paper Mills", *1978 Tappi Eng Conf*, pp. 349–357.

*Primary Examiner*—Steve Alvo

*Attorney, Agent, or Firm*—Cohen, Pontani, Lieberman, Pavane

[57] ABSTRACT

A method for washing a fibrous suspension. The fibrous suspension is dearated with a deaerating centrifugal pump as it is pumped into the washing zone. The washing water is also dearated with a deaerating centrifugal pump.

1 Claim, 6 Drawing Sheets

METHOD OF DEAERTING AND PUMPING A FIBER SUSPENSION PRIOR TO WASHING

This is a continuation of U.S. application Ser. No. 07/517,524, filed Apr. 27, 1990, which is a continuation of U.S. application Ser. No. 07/160,668, filed Feb. 26, 1988, both now abandoned.

TECHNICAL FIELD OF THE INVENTION

The present invention relates to a method and apparatus for improving certain industrial processes in the pulp and paper industry. In particular, the method and apparatus of the present invention relates to the deaeration or degasification of liquids or liquid suspensions—i.e. flowable material—which are the subject of various treatments in the processes of the pulp and paper-making industry.

BACKGROUND OF THE INVENTION

A number of processes utilized in the pulp and paper industry perform poorly or even unsatisfactorily because air or gases are mixed or entrained in the liquid or liquid suspension—i.e. the filtrate paper stock or paper pulp. Pulp often contains more than 10% air which is bound in the fiber network, primarily in the form of small bubbles.

In the manufacture of pulp—specifically, in the sulfate process after the digestion step—there is produced a waste liquor also known as black liquor. Black liquor binds considerable amounts of air and the volume of air entrained in the black liquor is dependent on both the temperature and the concentration thereof. Consequently, problems arise as, for example, in the washing of the pulp after the digester.

It is known to remove air from pulp mixtures, e.g. to secure the operation of the following processes: air is removed during the washing of pulp by the addition of dispersing and antifoaming agents; air is removed from filler black liquor supplied to a digester by surface active agents; and air is removed in the washing plant by specifically designing the filtrate tanks so that the surface area of the fiber suspension is greatly enlarged.

In the pumping of pulp, it is known to utilize pumps wherein air is removed for the sole purpose of insuring the proper operation of the pump. Most of the pumps used for separating air utilize an external source of suction for removing air which accumulates in the pump. It is also known that air bubbles created in front or immediately upstream of the impeller can cause clogging of the normally free passage from the pump inlet to the pump outlet. In these cases the pump impeller has heretofore been provided with holes or openings allowing the air to pass through the impeller under the force of an additional external vacuum system attached to or located proximate the pump. Generally, the external vacuum system is composed of a separate liquid ring pump or the like. Pumps utilizing such vacuum systems for the sole purpose of insuring control and proper operation of the pump are known from U.S. Pat. Nos. 4,410,337; 4,335,193 and 4,273,562. Apparatus for degasification of liquids are also known from U.S. Pat. Nos. 3,686,831; 4,201,555 and 4,600,431. U.S. Pat. No. 3,597,904 discloses an apparatus for separating gas from a liquid and having an external vacuum source for deaerating fiber pulp suspensions fed to a paper-making machine. Finally, Swedish Patent No. 363,363 discloses a centrifugal pump having a vacuum pipe in the center thereof connected to an external vacuum source for air removal.

Thus, these known pumps-remove air from the pump for the purpose of preventing loss of pump action due to the accumulation of air within the pump. It is also recognized that air accumulates in and about the center of the rotating impeller of a centrifugal pump due to pump-generated centrifugal forces which carry the heavier substances such as liquid and solid particles of the medium to be pumped towards the periphery of the flow while the lighter components of the medium—i.e. the air or gases—collect at the center of the pump. The accumulated air impedes the pumping process and gradually prevents the medium to be pumped from flowing to the impeller. Known deaeration methods include the removal of air in medium consistency pumping in which the paper pulp is fluidized, the air-gas mixture in the fluidized stock is separated in a gas separation zone and the air or gas is removed in the degassing zone through use of a vacuum pump. The removal of air from low consistency pulp can also be accomplished by Assignee's AIRSEP system. The common feature of these known deaeration systems and methods is that they are employed for the sole purpose of assuring continual and proper operation of the pump.

SUMMARY OF THE INVENTION

It is thus an object of the present invention to provide a method and apparatus for improving pulp and paper-making industry fiber-related processes which require the pumping of flowable materials—e.g. liquids and/or fiber suspensions—such as evaporation, thickening, washing, digesting and bleaching processes in which liquids such as black liquor, filtrate or fiber suspensions such as paper pulp are correspondingly treated. The improvement of the invention comprises substituting, for at least one of the pumps conventionally used in such processes, a pump provided with deaerating means, preferably with integral deaerating means, so as to remove air from the liquid or liquid fiber suspension.

It is a primary object of the present invention to provide a method and apparatus for improving evaporation, thickening, washing, digesting and bleaching processes of the pulp and paper industry wherein air or gas-containing liquids or liquid fiber suspensions are pumped and deaerated during the pumping thereof. This and other objects of the present invention will become clear from the following detailed description of the invention, the drawings and the appended claims.

DETAILED DESCRIPTION OF THE PREFERRED EMBODIMENTS

The present invention is based on a recognition, not heretofore known, that substantial improvements in the operating efficiency of a pulp or paper-making plant and processes can be realized by separating or removing air or gases that are mixed or entrained in the flowable pulp-containing material as the flowable material is pumped through the apparatus and treatment processes of the paper-making process. The following description will disclose, by way of example, the manner in which the invention may be applied in various phases of the paper-making process.

The invention is first described as applied to an evaporation plant wherein problems caused by the generation of foam, which in turn leads to both operational difficulties in the plant as well as to undesirable environmental consequences, are frequently encountered.

Figure 1:
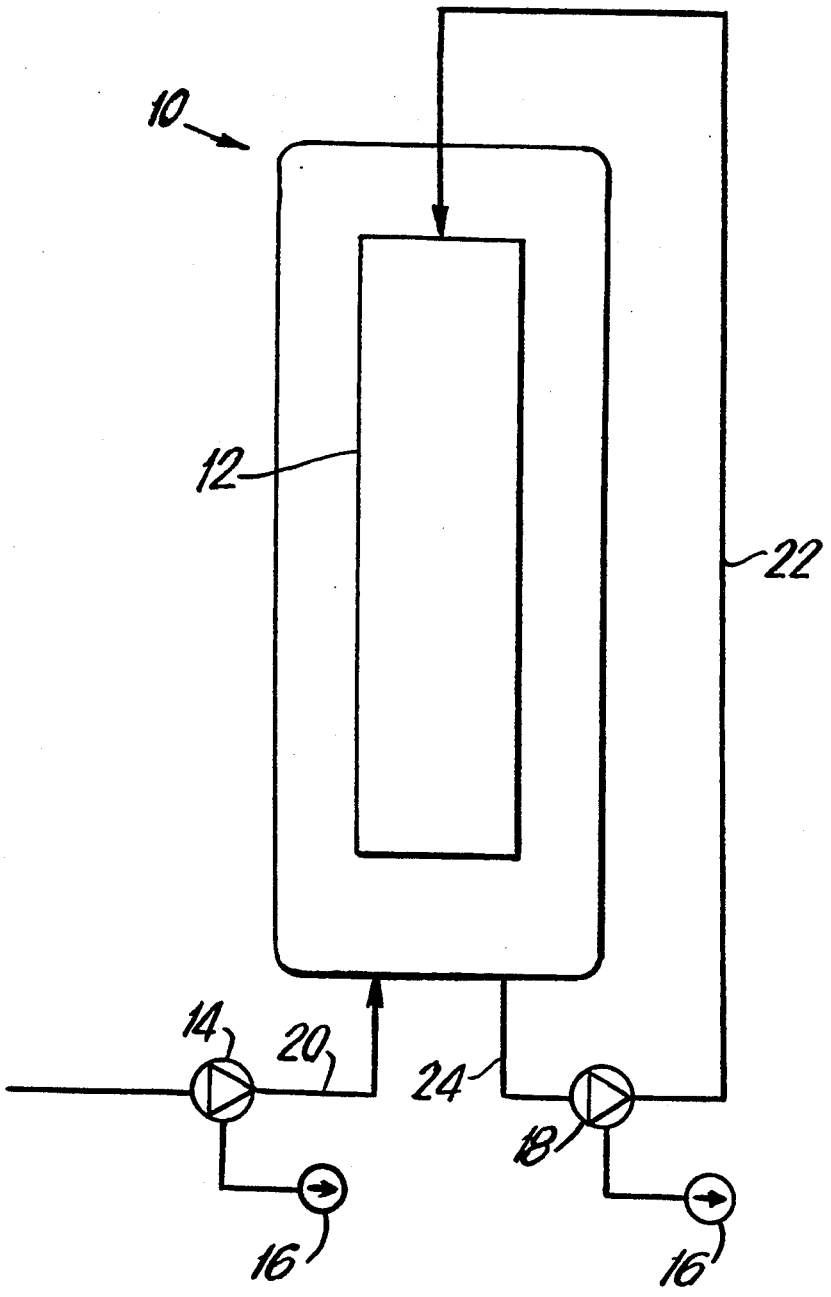
FIG. 1 is a schematic illustration of an evaporator employing the method and apparatus of the present invention.

FIG. 1 illustrates a typical evaporator 10 having heat transfer surfaces 12, a forced circulation pump 18 and a feed pump 14. Feed pump 14 is connected to evaporator 10 through a conduit 20. A circulation loop comprising conduits 22, 24 permits recirculation of the black liquor, preferably from the bottom of the evaporator to the top thereof. In known evaporators the pumps 14 and 18 are generally conventional centrifugal pumps.

In accordance with the present invention the conventional centrifugal pumps have been replaced by pumps provided with air removing means 16 whereby most or at least a substantial portion of the air, the pressure of which in the flowable material creates undesired foam, can be readily separated from the flowable material and removed in feed pump 14 through air removing means 16. If in addition a circulation pump 18 is employed—which is not present or necessary in all evaporators—at least a substantial portion of the remaining air can be removed from the black liquor in this same manner. To this end circulation pump 18 with air removing means 16 is employed to recirculate the liquid to be evaporated back to the heat transfer surfaces 12. It is also contemplated that circulation pump 18, which in heretofore-known evaporation plants has been needed to improve the efficiency of evaporation, may be dispensed with entirely. Due to the action of feed pump 14 with its air removing means 16, substantially less foam is deposited on the heat transfer surfaces 12, thus causing substantially less disturbance of the evaporation process with respect to conventional prior art evaporators.

The production of pulp utilizes various digestion methods by which pieces of wood, i.e. wood chips, are defiberized to wood fibers by chemical treatment. A common feature of these processes is that wood chips and the chemical digestion solutions are supplied to a digester. Air, both in a dissolved state and in the form of bubbles contained both in the wood chips and entrained in the chemical solutions, flows to the digester causing a variety of problems. In the digester, wood is cooked mostly in caustic soda so that the fibers are separated, creating weak waste liquor as a by-product of the chemical digesting operation. This waste liquor contains cooking chemicals and dissolved organic material. The dry solids content of this waste liquor is typically from about 15% to about 20%. To economically incinerate this waste liquor it is dried by evaporation to a solid content of from about 60% to about 70%. The incoming liquor usually contains from about 1% to about 2% of air which must be removed in the evaporation plant. The presence of relatively large amounts of air requires the treatment chemicals to defuse or penetrate through air bubbles before reaching the wood chips. The more air that is present in the liquor the slower and more uneven will be the intended effect on the pulp. In addition, the presence of large amounts of air renders difficult the desired downward movement of wood chips within the digester because the presence of air decreases the density of the wood fibers and causes the wood chips to float.

Figure 2:
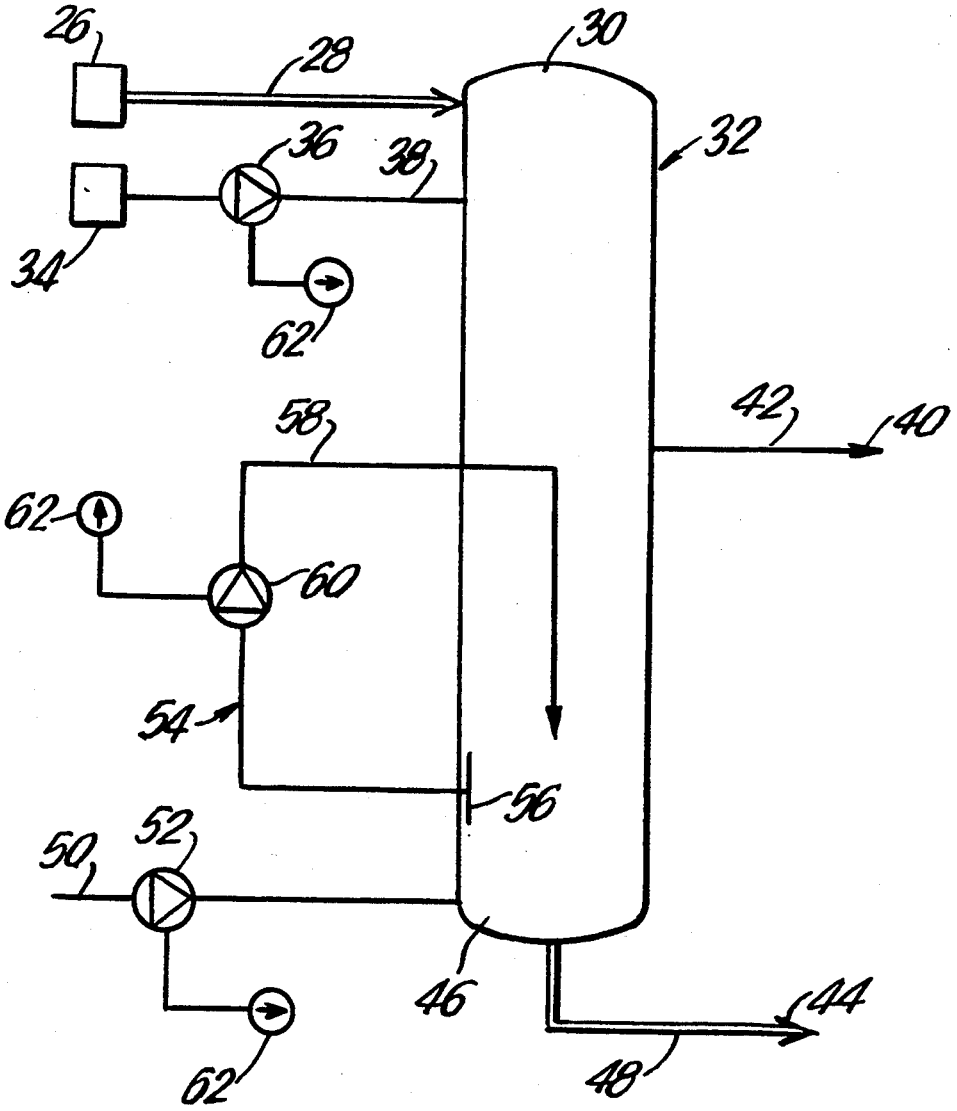
FIG. 2 is a schematic illustration of a pulp digester employing the method and apparatus of the present invention.

FIG. 2 is a schematic illustration of a commonly used, so-called KAMYR digester. Wood chips 26 are supplied under pressure through a conduit 28 to the top end 30 of a digester 32. The cooking chemicals 34, mainly caustic soda, are added to the digester by means of a pump 36 through conduit 38. The waste liquid 40 generated during the digestion process is discharged through a discharge conduit 42 preferably located proximate the middle of the digester 32. The fiber pulp 44 produced in the digestion process is discharged at the bottom 46 of digester 32 through conduit 48. Generally, washing water 50 is supplied by a pump 52 to digester 32 at the bottom thereof. Although not necessary to its operation, the digester is also usually provided with a liquid circulation system 54 composed of screens 56, circulation conduit 58 and one or more pumps 60. The digesting liquid is thus continuously withdrawn from digester 32, purified through screens 56 and recirculated to the digester either at about the middle thereof as shown in FIG. 2 or, optionally, at or about its top 30 (not shown).

In principal, the digester operates as follows: The wood chips flow downwardly within the digester together with the digestion chemicals. The spent digestion liquid or chemicals are then discharged from the digester. Washing water or liquid generally introduced at the bottom end of the digester flows upstream with the fiber material and is thereafter discharged with the spent chemicals as waste liquid. The washed pulp is discharged from the bottom part of the digester.

As previously mentioned, digesters are very sensitive to the presence of air. Air generally causes foam to gather at the upper end of the digester, thereby preventing proper control of the digesting process. In addition, air prevents the wood chips and the defiberized wood from flowing downward in the digester because the specific weight of the liquid in the digester is reduced by the presence of air. Utilizing the apparatus and method of the present invention, however, it is possible to substantially or entirely eliminate problems caused by the presence of air in the digester by providing deaeration means 62 in one or more of pumps 36, 52 which supply the respective liquids to the digester. Deaeration of the liquor 23 containing the cooking chemicals, which incorporates from about 1% to about 2% of air, and/or removing the air from the washing water or liquid 50, substantially decreases the air content of the liquids in the digester and thereby substantially eliminates the prior art foaming problems. By thus utilizing pumping devices with deaerating means in the digester operation in accordance with the present invention, the addition of surface active agents normally required in the operation of prior art digesters is substantially reduced or can be totally eliminated, resulting in large savings for the pulp or paper-making mill.

In pulp washing and/or bleaching processes, thickeners are generally employed to reduce the liquid content of the pulp and to wash the pulp. Although several types of thickeners are commercially available, their principles of operation are similar, and the presence of air in the washing and/or bleaching process has a significant detrimental effect on the operation of the respective process. For example, the presence of air substantially reduces the capacity of the washer and, in addition, negatively affects the results of the washing process.

Figure 3:
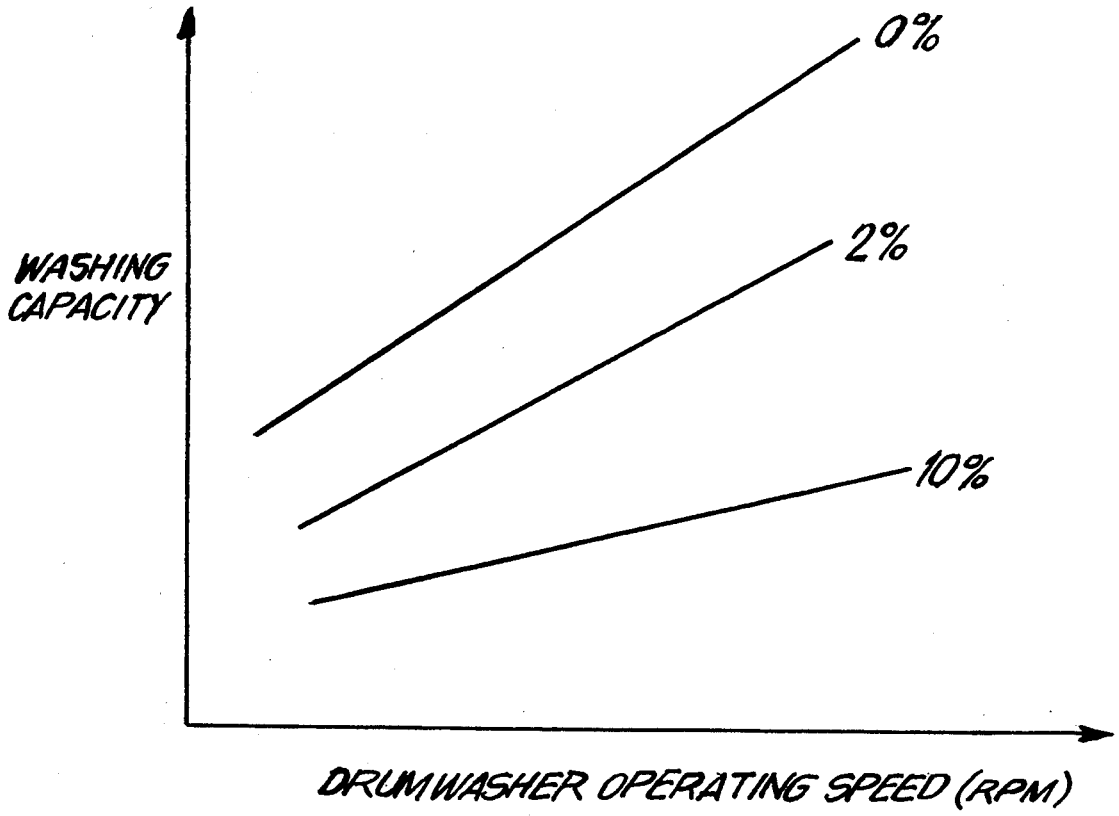
FIG. 3 is a graphic illustration of the capacity of a washing plant as a function of the air content of the pulp being processed.

FIG. 3 graphically illustrates the relationship between the capacity and operating speed of the washer for various percentages of air content in the pulp. The ordinate of FIG. 3 represents the washing capacity while the abscissa reflects the attainable rotational speed in revolutions per minute (rpm) of a conventional drum washer. Both the filtrate and the wood fiber material, i.e. the pulp, easily bind air, the air content frequently being over 10% in washing and bleaching plants. Air is particularly troublesome if present in form of bubbles.

Figure 4:
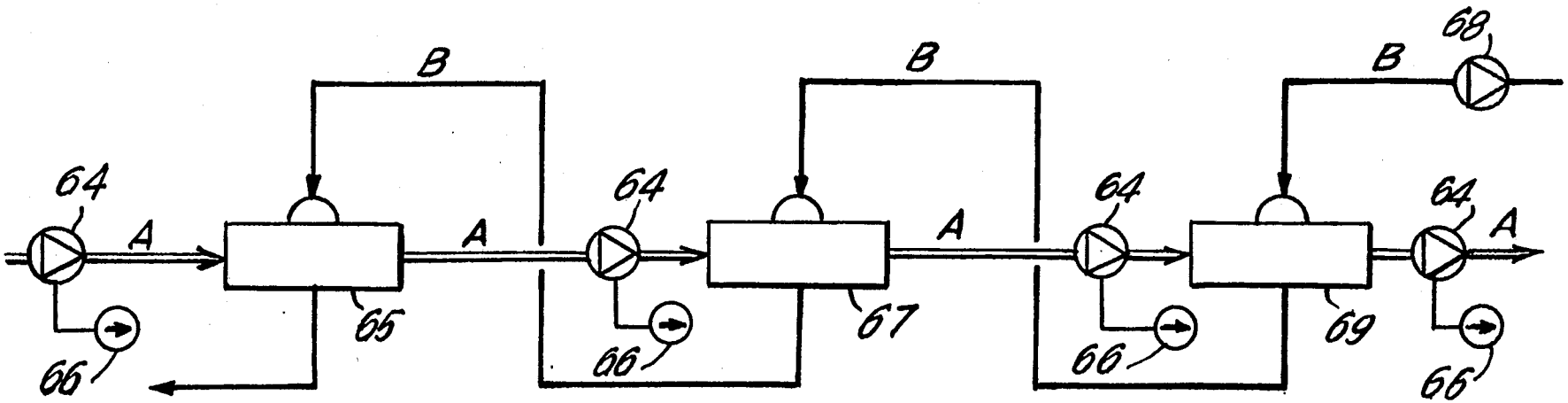
FIG. 4 is a schematic illustration of a washing plant employing the method and apparatus of the present invention.

In the washing process, after treatment in the digester, the fibers and waste liquor are separated. The fiber suspension is fed into the washer where the waste liquor is displaced by washing water or washing liquor. The displacement or efficiency ratio varies with the type of washer utilized but is generally between about 0.7 and about 0.9. The efficiency ratio is a representation of that portion of the original waste liquor displaced by the washing liquor. As illustrated in FIG. 4, a washing plant is commonly formed of a plurality of series-connected washers so that the total washing efficiency over the entire plant may be as high as about 0.95 to about 0.99. Problems relating to the presence of air generally include those caused in the washer and in the washing liquor present in the fiber suspension. When air is present in the fiber mat, where the actual displacement between waste liquor and washing liquor occurs, the flow pattern of the liquids is disturbed resulting in a reduction in washing efficiency. A further problem caused by the presence of air is the formation of foam in the liquor tanks and in the washer itself. These disturbances can be quite severe causing a substantial reduction in the capacity of the plant as well as unsatisfactory washing of the fibers.

FIG. 4 is a schematic illustration of a washing plant in which a first, second and third washer, designated by the respective reference numerals 65, 67 and 69, are connected in series. The flow of pulp is indicated by the letter "A" while the counter-current flow of the washing water is indicated by the letter "B". In accordance with the present invention, pumping devices 64 incorporating deaerating means 66 are provided in one or more of the pulp-feeding conduits before (upstream of) washer 65, between washers 65 and 67, between washers 67 and 69 and after (downstream of) washer 69. The counter-current flow "B" of pressurized washing water is provided by conventional pumping means 68 although, once again, deaerating pumps could be employed if deemed appropriate. Not shown are the usual filtrate tanks and pumps for pumping the filtrate, which are conventionally provided between the respective washers 65, 67, 69.

Figure 5:
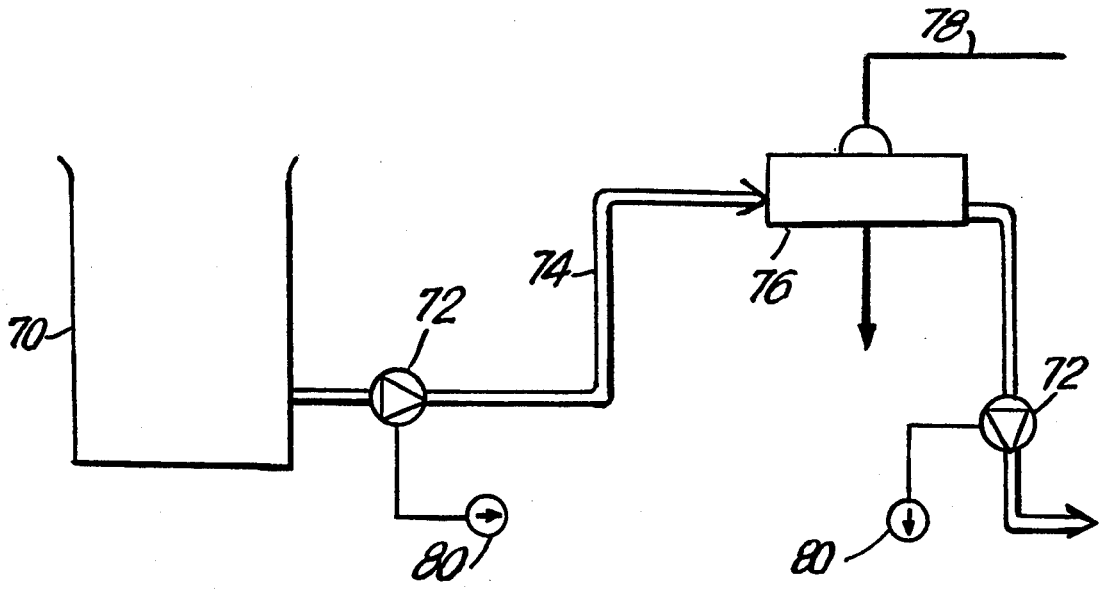
FIG. 5 is a schematic illustration of a bleaching plant employing the method and apparatus of the present invention.

FIG. 5 is a schematic illustration of a bleaching plant including a bleaching reaction tower 70 which is connected via conduit 74 to a washer 76. Washing liquid is supplied to washer 76 through conduit 78 in a manner similar to that described above. The pulp from the bleaching tower is transported through conduit 74 to the washer 76 and, from the washer, to the next stage by pumps 72 which, in accordance with the present invention, are provided with deaeration means 80 as more fully described hereinbelow. The following description of the operating principle of a typical washing phase is applicable to both the washing plant of FIG. 4 and the bleaching plant of FIG. 5.

In the washing plant, the flow "A" of pulp flow to washer 65 is effected by pump 64 after the pulp-containing flowable material has frequently been diluted with filtrate supplied from a filtrate storage tank in a recirculation or dilution cycle in a known manner. The flow "B" of washing water, is introduced into washer 65 from which the washed pulp is thereafter discharged and transported by a second pump 64 to the second washer 67 for further washing. As previously mentioned, the filtrate produced in each washing step is fed to a filtrate tank (not shown) from which a portion of the filtrate is recirculated to pulp flow A in a dilution/-recirculation cycle. Presently, various anti-foaming agents are used to control problems caused by the presence of air. Alternatively, or in addition, the cross-sectional area of the filtrate tank is designed for maximum width so as to provide the filtrate with a large surface area and thereby allow the removal of a small portion of the air present in the filtrate. Such conventional efforts at air removal, however, often add substantial expense to the construction and operation of the washing and/or bleaching plant and are, in addition, highly inefficient since only small amounts of air can be thereby be removed.

In accordance with the present invention, on the other hand, one or more of the conventional pumps 64 are replaced with pumping devices having deaerating means 66. The result of this substitution or replacement is considerably improved capacity and success in washing of the pulp in a washing and bleaching plant through removal of air from the pulp suspension prior to its entry into the respective washing stage. Moreover, utilization of pumping devices with deaerating means in accordance with the present invention has the added effect of substantially reducing or even eliminating the need both to add anti-foaming agents and for specially designed, large cross-section filtrate tanks.

The problems encountered by reason of the presence of air in the bleaching process are similar to those encountered in the washing plant which follows the digester. Of course, less washing is required at this stage. Referring now to FIG. 5, after treatment in the bleaching tower 70 the pulp is transported to washer 76 which generally operates at an efficiency of about 0.7 to about 0.8. The purpose of washer 78 is to reduce the content of impurities after the bleaching reaction and before the next treatment step. The problems caused by the presence of air at this point in the process are much like those encountered in the washing plant, namely, reduced capacity of the plant, foaming, and insufficient displacement of washing liquid by the bleaching liquor. As in the washing operation, the chemicals contained in the bleaching liquor—mostly chlorine gas, chlorine dioxide, oxygen, caustic soda and hypochlorite—penetrate the fibers. The presence of air prevents uniform penetration of the bleaching chemicals with the result of uneven bleaching of the fibers. In accordance with the method and apparatus of the present invention, however, conventional pumps are replaced by pumping devices having deaerating means, thereby markedly improving the operation, reliability and efficiency of the various processes used by the pulp and papermaking industry which involve the treatment of air and/or gas-containing liquids and/or liquid fiber suspensions—i.e. flowable materials.

Figure 6:
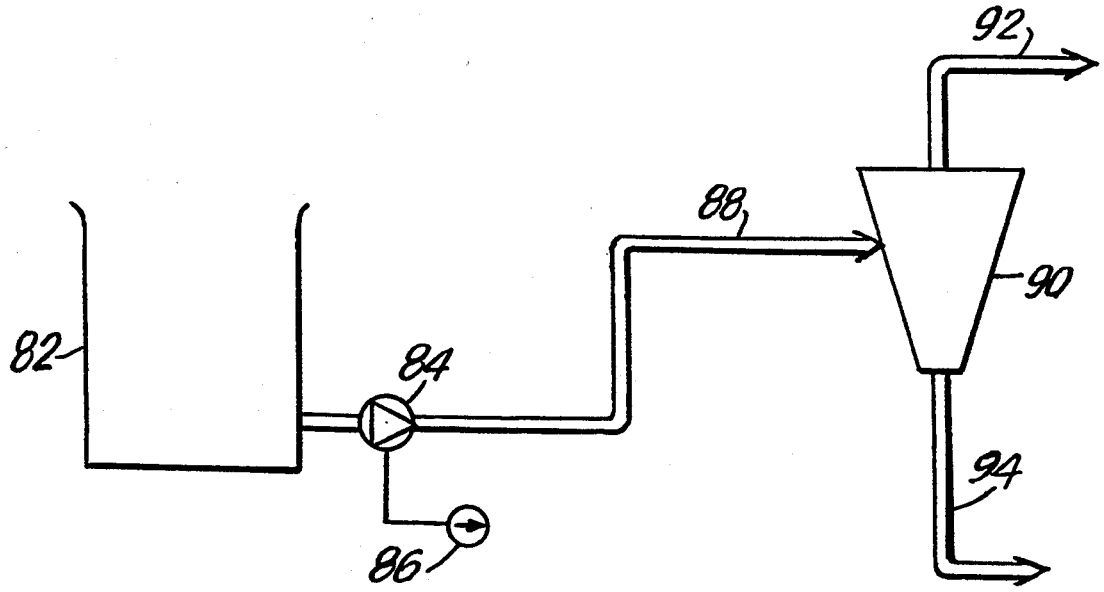
FIG. 6 is a schematic illustration of a hydro-cyclone employing the method and apparatus of the present invention.

It is a further object of the present invention to improve the operation and performance of hydrocyclones which are used for removing small impurities such as shives, sand, fiber bundles and the like from the fiber suspension. In general, and referring now to FIG. 6, the fiber suspension or pulp is transported from a storage container 82 by pumping it through a conduit 88 to hydrocyclone 90. In the hydrocyclone the fiber suspension is divided into a light-weight fraction, which is discharged through a conduit 92, and a heavy fraction for discharge through a conduit 94. The separating force in the cyclone is centrifugal; the pulp fed tangentially into hydrocyclone 90 by a pump 84 is rotated in the cyclone at a high rotational speed. As in washers, hydrocyclones are often built in series of 3 to 5 stages which feed one into the next to improve their overall operating efficiency.

The cyclone enables the separation of a heavy fraction from the main flow, the separated fraction typically being sand, heavy dirt or wood rejects such as knots and the like. A light-weight fraction comprising plastics, light-weight coating, bark and other light rejects is also separated in the hydrocyclone from the main flow. Which type of separation is chosen depends on the particular process, and the exact construction of the cyclone varies according to the desired separation. When the fiber suspension flows into the hydrocyclone it is subjected to strong centrifugal forces causing the heavier particles to move towards the circumference of the cyclone while air gathers in the middle or central portion thereof. More particularly, when cyclones are used in combination with flotation apparatus for recycled paper, the volume of air therein can become so great that the hydrocyclone plant fails to operate properly due to problems caused by the presence of air. The centrifugal forces acting on the suspension cause air to accumulate in the center of the operating hydrocyclone creating an air bubble which steadily grows and, as it does, increasingly disturbs the flow of the light-weight fraction, preventing its proper separation from the remaining flow. In accordance with the present invention, this separation problem in hydrocyclones is substantially reduced or eliminated by providing, preferably between the flotation apparatus and the hydrocyclone plant, a pumping device having deaerating means 86 for feeding the suspension to the hydrocyclone.

Thus, the method of the present invention is based on the finding and recognition that the use of one or more pumps which include or are associated with deaeration means for separating entrained air or gas from flowable materials as the materials are pumped or transported through the various treatment steps and processes in a pulp or paper-making operation results in greatly increased operating efficiency and a higher quality product and end result of the process. In accordance with the invention, an apparatus for pumping liquids and fiber suspensions for use in the above-described methods may be constructed so as to utilize external vacuum source (i.e. a system pump) through which, in a manner heretofore known, air or gas separated from the flowable material is removed from the pump. However, although pumps having a sufficiently strong external vacuum source may optionally be employed in this manner for practicing the present invention, it is preferred that a pump lacking or omitting such an external vacuum-generating means—but nevertheless still capable of removing the separated gas—be employed.

As an alternative to the use of an external vacuum source, the prior art suggests the removal of air by creating the vacuum pressure otherwise provided by the external vacuum pump through storage of the fiber suspension in a mass tower of sufficient height to ensure an appropriate over-pressure in front or upstream of the pump impeller. However, in pumping high consistency pulp and without unusually high suction pipes or drop legs the magnitude of pressure required for independent air removal in this manner cannot thereby be obtained. It should also be noted that the amount of air in the fiber suspension increases with increasing consistency of the pulp suspension.

Figure 7:
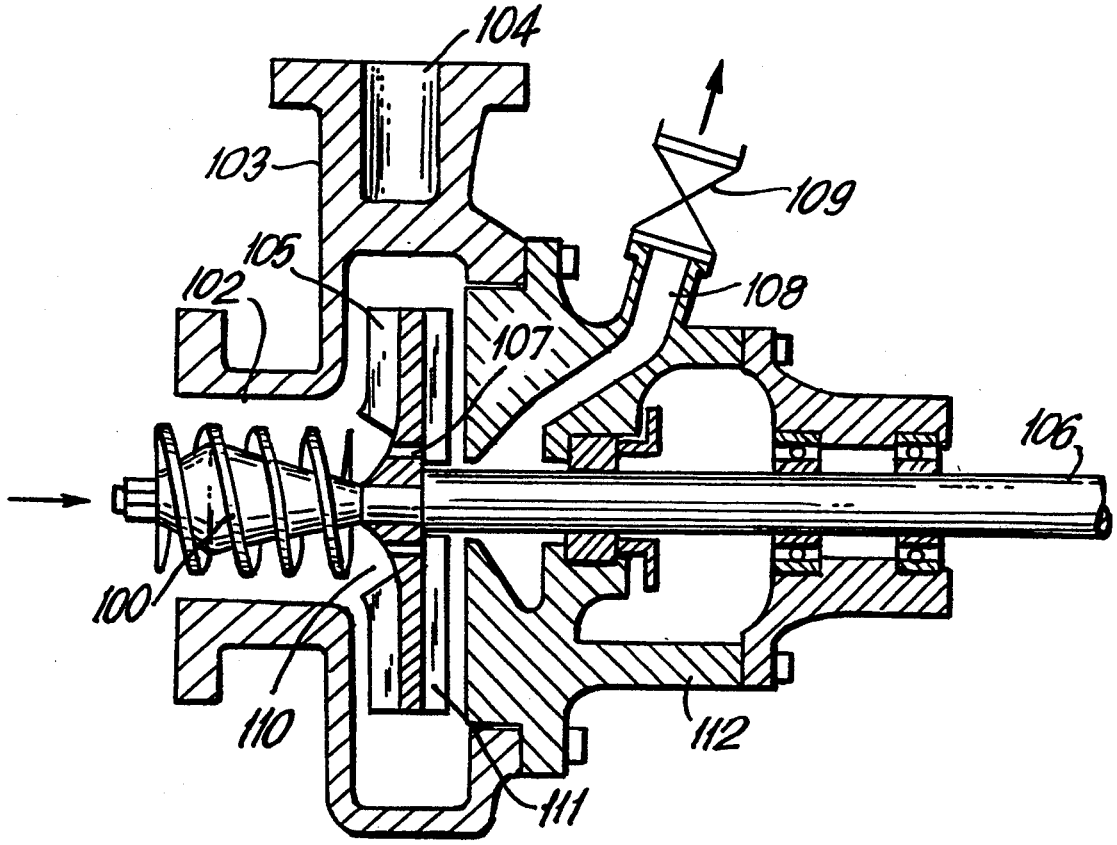
FIG. 7 is a cross-sectional view of a pump apparatus for use in the practice of the method of the present invention.

In accordance with a particularly preferred embodiment of the present invention, the required pump inlet pressure is obtained by utilizing a feed means such, for example, as an inducer or propeller. The feed means is constructed so that a high pressure is created in the area adjacent the impeller of the pump. FIG. 7 illustrates an embodiment in accordance with the present invention wherein a feed means 100 is arranged inside pump inlet 102. The pump is an otherwise generally conventional centrifugal pump provided with a casing 103 having an inlet channel 102 and an outlet opening 104. The casing is attached to the pump housing 112 which includes the stuffing boxes or the like and the bearings for the motor-driven shaft 106. The impeller 105 is mounted for rotation within casing 103 on a shaft 106 behind or immediately downstream of feed means 100. Openings 107 defined in and through the back plate of the impeller communicate with one or more channels 108 located behind the pump impeller 105 within housing 112 for allowing removal of the separated air. A valve 109 may be arranged in channel 108 for regulating the pressure difference between the front 110 of the impeller 105 and the rearwardly disposed gas outlet channel(s) 108. Impeller 105 may also be provided with blades 111 on the rear side thereof for returning to the main flow any suspension that may be drawn with the separated air or gas through the impeller openings 107.

In operation, the rotating feed means 100—in this case the inducer—advances the pulp suspension towards impeller 105. The impeller subjects the pulp suspension to centrifugal forces causing the separation of entrained air from the pulp and forming a gas bubble at or about the center of the impeller. The pressure created by the inducer 100 in front of impeller 105 is, however, greater than the pressure in the gas outlet channel(s) 108 behind the impeller so that the gas is caused to flow through impeller openings 107 and into channel(s) 108 for release to, for example, the outside or ambient air. Thus, in the apparatus according to the present invention, the gas bubble created in front or upstream of the impeller is continuously removed and consequently does not negatively affect the pumping process as has been the case in the prior art. The incoming fiber suspension also facilitates and assists the flow of separated air/gases through the openings 107 in the back plate of the impeller and through discharge channel(s) 108 in the pump housing, thus continuously removing the air from the liquid or fiber suspension and from the interior of the pump without the use of an external vacuum source. The deaerated or degasified pulp is pumped into spiral casing 103 and exits the pump through outlet 104.

It is a further advantage of the apparatus of the present invention that the pressure required to force the separated air through the openings 107 in impeller 105 is created proximate adjacent the front of the impeller by a pressure differential and not by pushing the fiber suspension against the impeller since the impeller provides the rotational movement required for the separation of air from the suspension and thus creates an over-pressure in front of the pump impeller. Due to the continuous separation of air from the pulp suspension a constant gas flow from the center of impeller 105 to gas outlet channel 108 is achieved. As previously mentioned, the deaerated fiber suspension is radially outwardly moved or driven by the rotation of impeller 105 into the spiral casing 103 towards outlet opening 104 in a known manner.

While the invention has been herein shown and described in connection with what is presently considered to be the most practical and preferred embodiments thereof, it will be apparent to those of ordinary skill in the art that many modifications may be made to the disclosed embodiments within the scope of the invention, which scope is to be accorded a broad interpretation so as to encompass all equivalent structures and methods. For example, feed means 100 may be implemented by an inducer formed as a screw or a propeller which may be part of the impeller or a separate device. The impeller includes those commonly used in centrifugal pumps and may be provided with different kinds of sealing or back blade structures. Instead of being discharged through channel 108 located within housing 112, the separated gas may be discharged through shaft 106, the impeller hub or the impeller back plate. There may also be one or several discharge channels in the pump housing. The discharge channel(s) may lead directly to the ambient air or to some other area or space at ambient or other pressure as desired or appropriate for the particular process such, for example, as the pressure at the inlet to the pump prior to the inducer. And the pump inlet channel 102 may be tapered toward the pump impeller.

Finally, the separation of air or gas from the liquid or liquid fiber suspension at the pump can be achieved by the application of ultrasonic waves to the flowable material. Pumps provided with air removal devices do not tend to efficiently separate air which is dissolved in the liquid. Dissolved air passes through the pump. Although such dissolved air does not substantially impede the pumping process itself it is in many ways harmful in later treatment processes as, for example, in the form of foam. In addition, as previously pointed out the presence of air impedes the efficacy of added chemicals. It has been found that dissolved air may be separated from the flowable material in the form of bubbles by the application of high frequency waves such as ultrasonic waves either within the pump or upstream of the pump by generating alternate zones of higher and lower pressure in a known manner. In the low pressure zones the air is thus separated forming bubbles of gas. The gas is thereafter collected and separated in the pump and can thus be removed.

These and other modifications are all within the scope and contemplation of the invention.

What is claimed is:

1. A method of improving the feeding of a air-containing fiber suspension into a washer and the washing of the material with washing water, the method consisting essentially of:

feeding the fiber suspension into the washer; treating the fiber suspension in the washer with washing water;

discharging the washed fiber suspension from the washing zone;

simultaneously pumping and deaerating the air-containing fiber suspension in the feed line with a deaerating centrifugal pump prior to the fiber suspension entering the washer; said deaerating centrifugal pump being the sole deaerator in said feed line;

and wherein said washing water is deaerated prior to its introduction into the washer with a deaerating centrifugal pump.

* * * * *